US008800306B2

(12) United States Patent
Schoenoff et al.

(10) Patent No.: US 8,800,306 B2
(45) Date of Patent: Aug. 12, 2014

(54) PORTABLE REFRIGERANT RECOVERY MACHINE

(75) Inventors: Michael Steven Schoenoff, Rochester, MN (US); Mark McMasters, Owatonna, MN (US)

(73) Assignee: Bosch Automotive Service Solutions LLC, Warren, MI (US)

( * ) Notice: Subject to any disclaimer, the term of this patent is extended or adjusted under 35 U.S.C. 154(b) by 928 days.

(21) Appl. No.: 12/341,257

(22) Filed: Dec. 22, 2008

(65) Prior Publication Data

US 2010/0154442 A1 Jun. 24, 2010

(51) Int. Cl.
*F25B 45/00* (2006.01)

(52) U.S. Cl.
CPC ..... *F25B 45/00* (2013.01); *F25B 2345/005* (2013.01); *F25B 2345/006* (2013.01)
USPC ..... 62/77; 417/273

(58) Field of Classification Search
CPC ..... F25B 45/00; F25B 45/001; F25B 45/002; F25B 45/003; F25B 45/005
USPC ..... 62/77; 417/273, 415, 521
See application file for complete search history.

(56) References Cited

U.S. PATENT DOCUMENTS

| | | | | | |
|---|---|---|---|---|---|
| 1,677,539 | A * | 7/1928 | Wollman | 74/55 |
| 2,553,063 | A * | 5/1951 | Simpson et al. | 417/273 |
| 3,833,318 | A * | 9/1974 | Nakayama et al. | 418/100 |
| 3,910,729 | A * | 10/1975 | Jepsen et al. | 417/417 |
| 4,957,416 | A * | 9/1990 | Miller et al. | 417/273 |
| 5,024,061 | A * | 6/1991 | Pfeil et al. | 62/77 |
| 7,037,090 | B2 * | 5/2006 | Leu | 417/415 |
| 8,388,317 | B2 * | 3/2013 | Sung | 417/273 |
| 2005/0271530 | A1 * | 12/2005 | Beagle | 417/440 |
| 2006/0096738 | A1 * | 5/2006 | Kang et al. | 165/80.4 |
| 2006/0127231 | A1 * | 6/2006 | Sundheim | 417/234 |
| 2007/0140888 | A1 * | 6/2007 | Gannaway et al. | 418/160 |
| 2010/0319547 | A1 * | 12/2010 | Kondou et al. | 96/143 |
| 2011/0132018 | A1 * | 6/2011 | Chang | 62/298 |
| 2012/0023972 | A1 * | 2/2012 | Pearl et al. | 62/77 |
| 2012/0023973 | A1 * | 2/2012 | Mayorca | 62/77 |

FOREIGN PATENT DOCUMENTS

| | | | |
|---|---|---|---|
| CN | 201358901 Y | * | 12/2009 |
| CN | 102226450 A | * | 10/2011 |
| WO | WO 2005026546 A1 | * | 3/2005 |

* cited by examiner

*Primary Examiner* — Ljiljana Ciric
*Assistant Examiner* — Alexis Cox
(74) *Attorney, Agent, or Firm* — Baker & Hostetler LLP

(57) ABSTRACT

A refrigerant recovery machine includes two opposed and off-set pistons. The pistons are received in cylinders that are able to move depending on the alignment of the pistons.

25 Claims, 4 Drawing Sheets

PORTABLE REFRIGERANT RECOVERY MACHINE

FIELD OF THE INVENTION

The present invention relates generally a portable refrigerant recovery machine. More particularly, the present invention relates to a portable refrigerant recovery machine having opposed two-cylinder compressor for refrigerant transfer.

BACKGROUND OF THE INVENTION

Portable refrigerant recovery machines are used to transfer refrigerant from a refrigerant containing device, such as an air-conditioning unit for a home to a refrigerant storage tank. Many recovery machines are designed with a single cylinder, "oil less" compressor and include a pressurized crank case, which increases pressure during the intake stroke, thereby storing potential energy in the compressed refrigerant. As the piston begins the compression stroke, the stored potential energy in the compressor refrigerant in the crank case is used to help push the piston up the stroke and compress the refrigerant in the cylinder against the head pressure. This "assist" reduces the required load on the motor since 180 degrees of the motor's revolution is used to store energy in the compressed refrigerant crankcase when it would otherwise be wasted by merely moving the piston down the cylinder. A disadvantage to this arrangement is that the refrigerant will remove the lubrication in the moving components in the crankcase, which are typically ball bearings, leading to accelerated failure of the compressor. Further, one cylinder compressor can only move a certain volume of refrigerant once during a single motor revolution.

Accordingly, it is desirable to provide refrigerant recovery machine that does not require a pressurized crankcase and has a two cylinder compressor to move more refrigerant during a single motor rotation.

SUMMARY OF THE INVENTION

The foregoing needs are met, to a great extent, by the present invention, wherein in one aspect an apparatus is provided that in some embodiments include a two piston compressor.

In accordance with one embodiment of the present invention, a portable refrigerant recovery machine is provided, which can include a manifold having an inlet valve to receive refrigerant into the machine and an outlet valve for exiting the refrigerant from the machine, a compressor that receives the refrigerant from the manifold and compresses the refrigerant, the compressor further include a first head that receives a first end of a first cylinder and includes a first head inlet and a first head outlet, a second head that receives a first end of a second cylinder and includes a second head inlet and a second head outlet, a crankcase coupled to second ends of the first and second cylinders, a crankshaft journal positioned within the crankcase and connected to a first end of a first connecting rod and a first end of a second connecting rod, a first pin that couples a second end of the first connecting rod to a first end of a first piston, and a second pin that couples a second end of the second connecting rod to a first end of a second piston, wherein the first piston and the second piston are opposed and off-set from each other and the first and second pins allow the connecting rods to rotate around the pins, a motor coupled with the crankshaft journal to move the pistons, a condenser to condense the refrigerant, and a housing to house the manifold, the compressor, the motor and the condenser.

In accordance with another embodiment of the present invention, is a method of moving a refrigerant in a refrigerant recovery machine, which can include the steps of receiving the refrigerant into a manifold, compressing the refrigerant with a compressor having two opposed and off-set pistons, moving the refrigerant from the compressor to a condenser, condensing the refrigerant with the condenser, cooling the condenser with a fan, and moving the refrigerant from the condenser to the manifold.

In accordance with yet another embodiment of the present invention, a portable refrigerant recovery machine is provided, which can include a manifold means for directing a refrigerant having an inlet valve means for receiving the refrigerant into the machine and an outlet valve means for exiting the refrigerant from the machine, a compressing means for compressing the refrigerant from the manifold means, the compressing means further includes a first head means for containing a first end of a first cylinder means and includes a first head inlet and a first head outlet, a second head means for containing a first end of a second cylinder means includes a second head inlet and a second head outlet, a crankcase means coupled to second ends of the first and second cylinders means, a crankshaft journal for moving positioned within the crankcase means and connected to a first end of a first connecting rod means and a first end of a second connecting rod means, a first pin means for securing that secures a second end of the first connecting rod means to a first end of a first piston means; and a second pin means for securing that secures a second end of the second connecting rod means to a first end of a second piston means, wherein the first piston means and the second piston means are opposed and off-set from each other and the first and second pins means allow the connecting rods means to rotate around the pins means, a motor means for rotating the crankshaft journal means to move the pistons means, a condensing means for condensing the refrigerant, and a housing means to house the manifold means, the compressing means, the motor means and the condensing means.

In accordance with still another embodiment of the present invention, a compressor to refrigerant from refrigerant source is provided, which can include a first head that receives a first end of a first cylinder and includes a first head inlet and a first head outlet, a second head that receives a first end of a second cylinder and includes a second head inlet and a second head outlet, a crankcase coupled to second ends of the first and second cylinders, a crankshaft journal positioned within the crankcase and connected to a first end of a first connecting rod and a first end of a second connecting rod, a first pin that couples a second end of the first connecting rod to a first end of a first piston, and a second pin that couples a second end of the second connecting rod to a first end of a second piston, wherein the first piston and the second piston are opposed and off-set from each other and the first and second pins allow the connecting rods to rotate around the pins.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
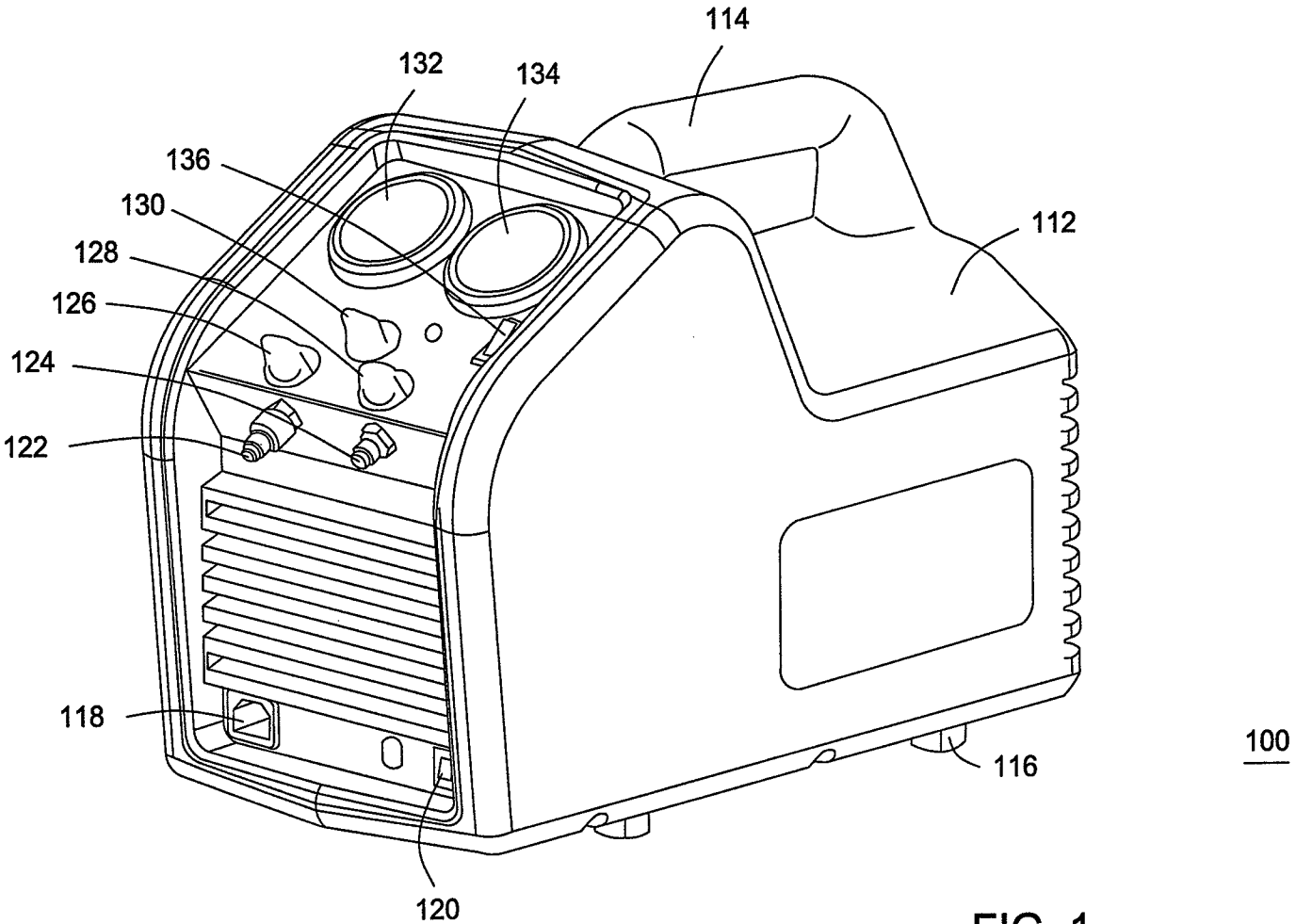
FIG. 1 is illustrates a perspective view of a refrigerant recovery machine according to an embodiment of the invention.

The invention will now be described with reference to the drawing figures, in which like reference numerals refer to like parts throughout. An embodiment in accordance with the present invention provides a portable refrigerant recovery machine having opposed two cylinders in order to increase the work load of the machine.

An embodiment of a portable refrigerant recovery machine 100 of the present invention is illustrated in FIG. 1. The recovery machine includes a case 112 that may be made from molded plastic and the like. The case 112 is designed to enclose the major components, discussed below, of the recovery machine 100. The recovery machine 100 also includes a handle 114 for a user to use to move the recovery machine from one place to another. The handle can be made from the same material as the case 112 or from an elastomeric material for more comfort to the user. Feet 116 are positioned on a bottom portion of the case 112 in order to keep the recovery machine 100 from touching the ground.

A power connection 118 provides power to the recovery machine 100 when plugged into a power source. A circuit breaker 120 is provided to protect the recovery machine 100 from any surge in the power source. The circuit breaker 120 and power connection 118 are provided on a front portion of the machine 100.

The front portion of the machine 100 also includes an inlet fitting 122 and an outlet fitting 124. The inlet fitting 122 can be used to receive refrigerant from the refrigerant containing device and the outlet fitting 124 can be used to send the recovered refrigerant to the refrigerant storage device. The inlet fitting 122 can include a replaceable filter (not shown) to remove any contaminants that may be in the recovered refrigerant of the refrigerant containing device. Control knob 126 can be used to control the functionality of the inlet fitting 122 and control knob 128 can control the functionality of the outlet fitting 124. A self purge valve control 130 is provided to purge contaminants or remaining refrigerant from the machine. High side and low side pressure gauges 132 and 134 are provided on the top surface to show the respective pressures. A power button 136 is also provided on the top surface to turn on and off the recovery machine 100.

Figure 2:
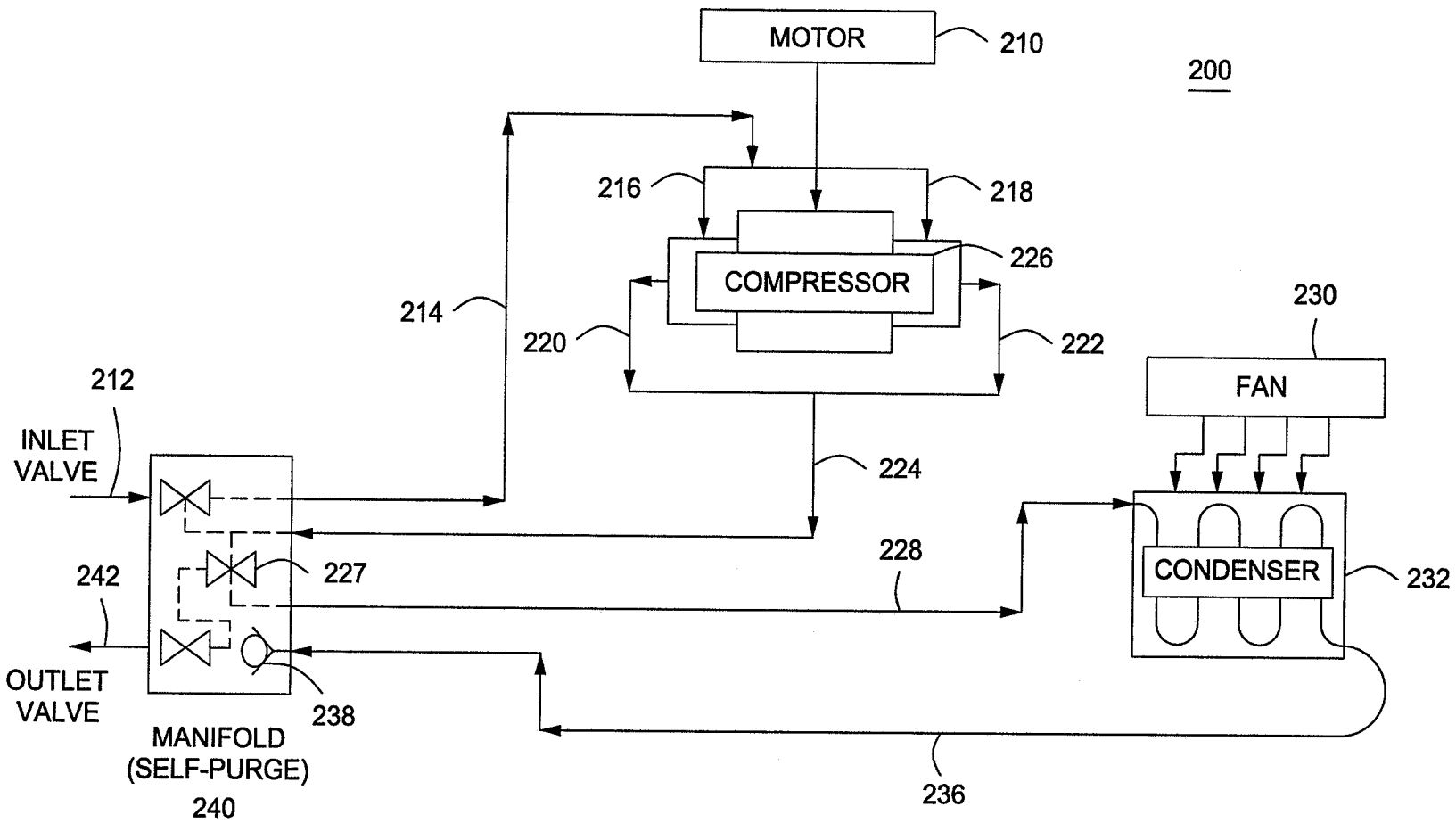
FIG. 2 illustrates a block diagram of the major components of the refrigerant recovery machine according to an embodiment of the invention.

FIG. 2 illustrates a block diagram of the major components of the refrigerant recovery machine 100 according to an embodiment of the invention. A motor 210 which is coupled to a compressor 226 in order to reciprocate pistons 334 (see FIG. 3) therein. The details of the compressor 226 are discussed further below. The inlet fitting 122 includes an inlet valve 212 that can be controlled by the control knob 126 as to be open or closed. As noted, the refrigerant from the refrigerant containing device enters the inlet valve and flows to the compressor 226 as shown in flow path 214. Flow path 214 then further splits into flow paths 216 and 218 then both enter the compressor 226 and into separate cylinders 324 (see FIG. 3).

With the actions of the pistons 334 in the cylinders 324, the refrigerant is forced at the respective ends of the compressor into pathways 220 and 222 which combine back into a pathway 224, which then proceeds through a valve 227. Valve 227 relates to a purge function of the machine 100. From valve 227, the refrigerant travels via flow path 228 to a condenser 232. A fan 230 helps keep the condenser cool while it is operating. The refrigerant flows from the condenser 232 to an outlet valve 242 via flow pathway 236. A check valve 238 is provided in a manifold 240 in order to allow flow of refrigerant only from the condenser to the outlet valve 242 and not from the refrigerant storage tank into the recovery machine 100. The manifold 240 includes the inlet valve 212, the outlet valve 242, the valve 227 and check valve 238.

Figure 3:
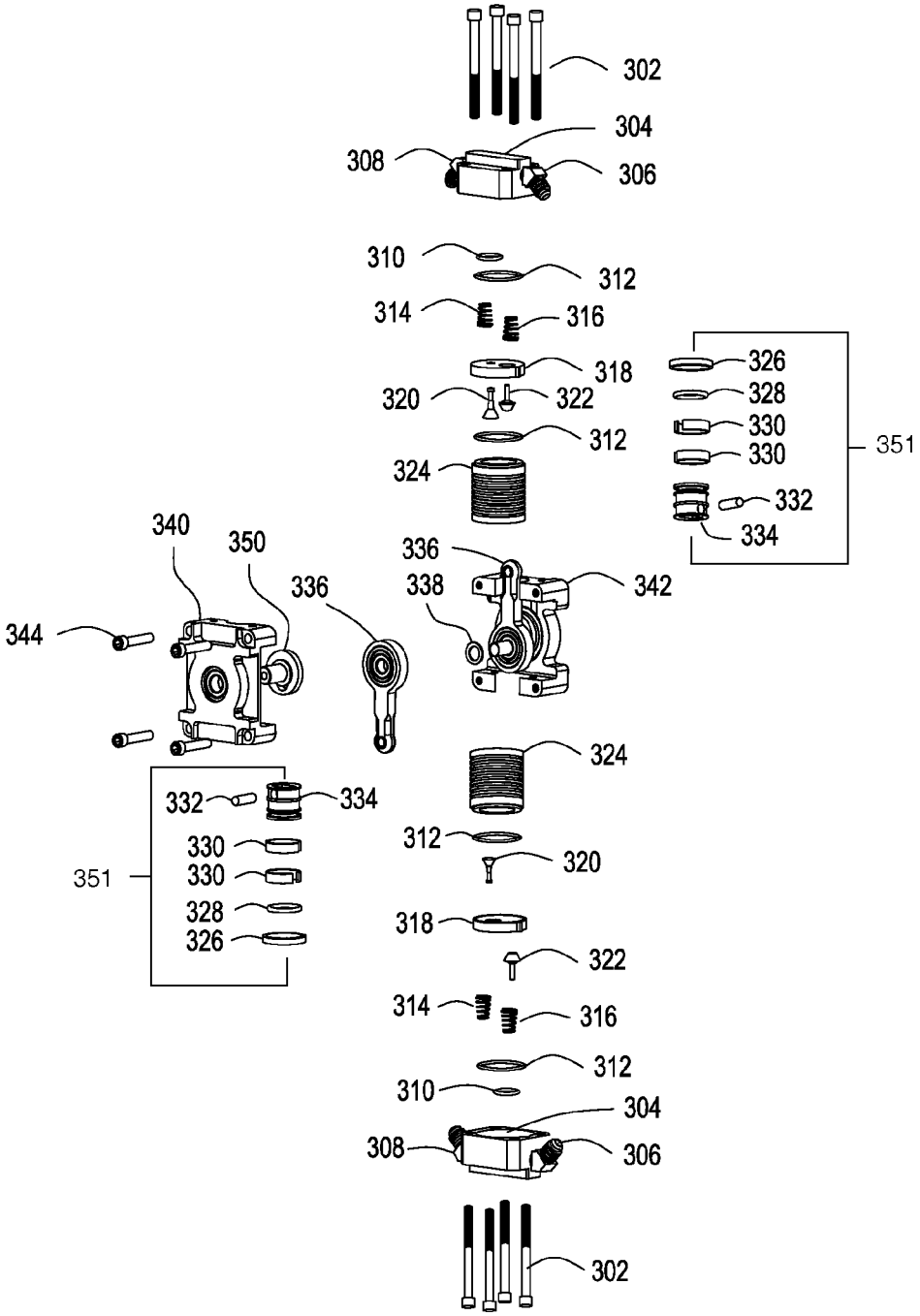
FIG. 3 illustrates an exploded assembly view of a compressor according to an embodiment of the invention.

FIG. 3 illustrates an exploded assembly view of the compressor 226 according to an embodiment of the invention. A head 304 is provided and can include only one part or two parts, as shown. The head 304 includes head inlets 306 and head outlets 308. The head inlets 306 can receive refrigerant that flows into cylinders 324 from flow paths 216 and 218 (FIG. 2), respectively. The head 304 is configured to receive screws 302. Although four screws 302 are shown, any number of screws may be used including, one, two, three, five, six and others in order to couple the head 304 to a front crank case 340 and a rear crank case 342. The head outlets 308 provide the conduits in which the refrigerant exits from the compressor 226 and forms flow paths 220 and 222 (FIG. 2). The head 304 also contains o-rings 310 and 312. The o-rings are made from an elastomeric material or neoprene and help to prevent the refrigerant from leaking from the compressor.

Input valve springs 314 and valve springs 316 are also positioned within the head 304 and push input valves 320 and output valves 322 against valve plate 318 to facilitate sealing. Piston assemblies 351 can be constructed and arranged to be positioned within the cylinders 324 and to be coupled to connecting rods 336 via pins 332. The piston assemblies include piston seals 326, o-rings 328, wear bands 330, pistons 334 and pins 332. The wear bands 330 reduce wear and tear on both the pistons and cylinders, and the seals help seal any gap between the pistons and cylinders. The pistons 334 reciprocate within the cylinders due to the actions of the connecting rods 336.

The connecting rods 336 are each received in the front and the rear crankcase 340 and 342. A crankshaft journal 350 receives both connecting rods at the rods' larger circular region. The crankshaft journal 350 is ultimately connected to the motor 210 (FIG. 3). The motor 210 rotates the crankshaft journal 350, which ultimately rotates the connecting rods 336, which in turn rotates the pistons 334, reciprocally. Screws 344 couple the front and rear crankcases together. As described above, there may be more or less screws than as shown. With the crankcases coupled together, they help to secure the connecting rods in place during the rods' rotations.

Figure 4:
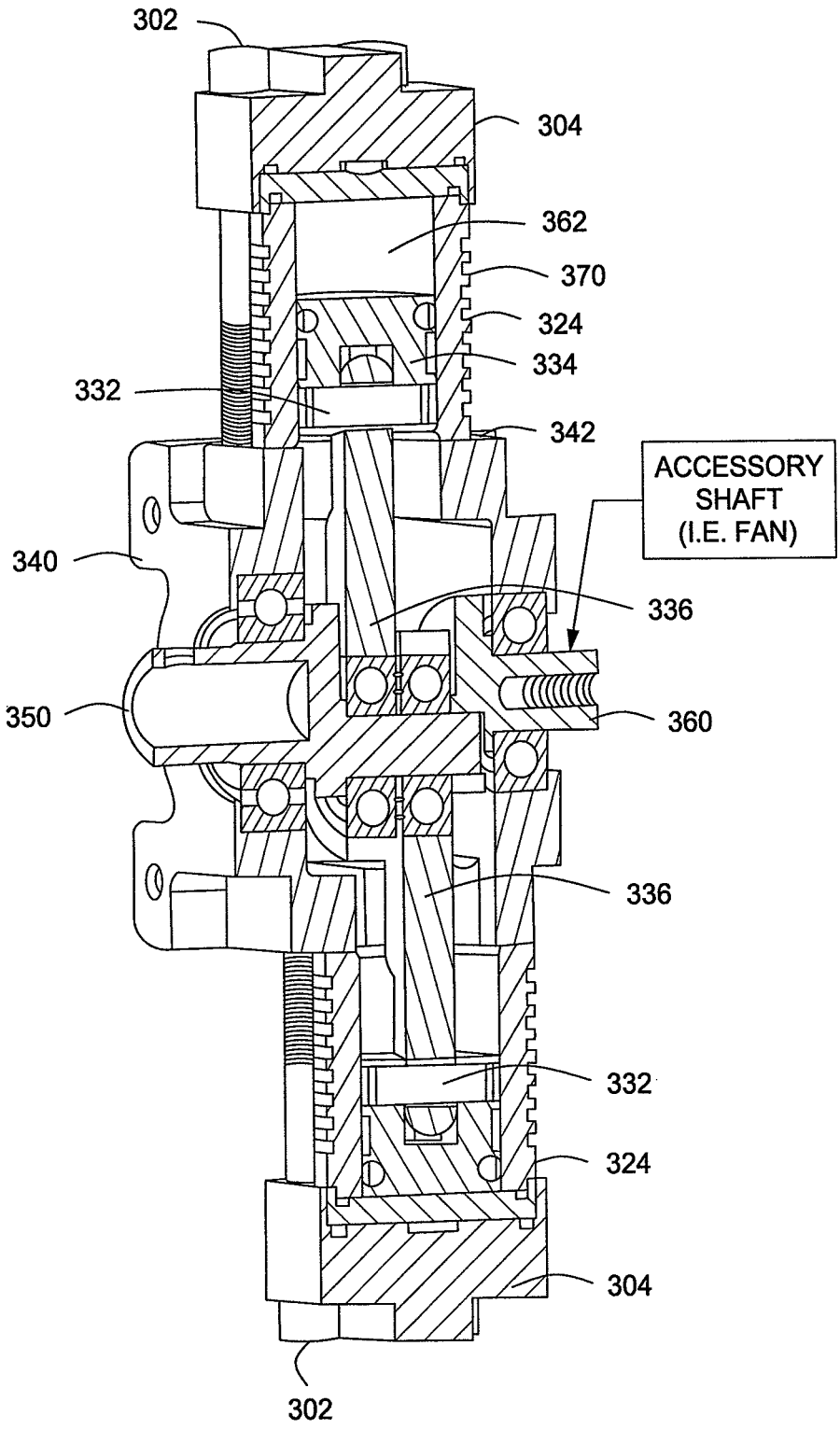
FIG. 4 illustrates a cross section of an assembled compressor according to an embodiment of the invention.

FIG. 4 illustrates a cross section of an assembled compressor 226 according to an embodiment of the invention. Screws 302 are shown coupling the head 304 to the front crankcase 340. In the top portion of the compressor 226, the piston is in a "lower position" or non-extended position in the cylinder thus creating a space 362. When the piston is in the lower position, it creates a vacuum thereby drawing in refrigerant into the space 362. Additionally, the vacuum created in the space 362 also can extend to a vacuum being created in the refrigerant containing device so that to the extent possible, all of the refrigerant in the refrigerant containing device can be recovered.

The cylinder 324 includes grooves 370 on its outer surface so that it can be easily cooled by the fan. The cylinder 324 one end is received in grooves (not shown) in the head 304 and is free floating on the second end that is next to the crankshafts. This allows for a certain amount of play so that the cylinder can readjust should the piston being reciprocated therein is off its alignment with the cylinder. This helps to reduce damage to the cylinder should the piston be misaligned. Additionally, in one embodiment, the pistons shown in FIG. 4 are not aligned on the same axis but rather are off-set from each other. This reduces vibrations and evens the load on the motor and is further discussed below. However, in another embodiment, the pistons and cylinders can be on the same axis with each other.

Also shown is the pistons 334 being coupled to the connecting rods 336 by pins 332. The pins allows the connecting rods to rotate as it is being translated by the motor.

In the lower portion of the compressor 226, the piston is in a "higher position" or an extended position, there is no space created. Rather, in this position, the refrigerant can be compressed and sent out of the compressor. Although shown in an up and down position, the compressor can be placed any angle.

FIG. 4 also illustrates an accessory shaft 360, where, for example, a fan can be attached there to. On the other side of the accessory shaft is the crankshaft journal 350 that attaches to a motor. The rotation of the crankshaft journal 350 by the motor moves the connecting rods 336 and their respective pistons in opposite direction and opposed to each other. So that the movement of the pistons and the associated vibrations on one end of the compressor is off-set by the movement and vibration of the piston. This creates a more stable compressor and prevents unnecessary damage to the compressor. In other words, one end of the compressor will draw in the refrigerant into it and the other end forces the compressed refrigerant out. Further, this will even the load that is placed on the motor.

In another embodiment, the cylinder and head can be made from one piece or cast in once piece if they are made from an alloy, such as aluminum. In still another embodiment, the cylinder, head and crankcase can be made form one piece or cast in once piece if they are made from an alloy, such as aluminum.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A portable refrigerant recovery machine, comprising:

a manifold having an inlet valve to receive refrigerant into the machine and an outlet valve for exiting the refrigerant from the machine;

a compressor that receives the refrigerant from the manifold and compresses the refrigerant, the compressor further comprising:

a first head that receives a first end of a first cylinder and includes a first head inlet and a first head outlet;

a second head that receives a first end of a second cylinder and includes a second head inlet and a second head outlet;

a crankcase coupled to second ends of the first and second cylinders;

a crankshaft positioned within the crankcase, the crankshaft having an axis of rotation, and the crankshaft comprises a single crankshaft journal connected to a first end of a first connecting rod and a first end of a second connecting rod such that the first end of the first connecting rod and the first end of the second connecting rod move in unison;

a first pin that couples a second end of the first connecting rod to a first end of a first piston; and a second pin that couples a second end of the second connecting rod to a first end of a second piston, wherein the first piston and the second piston are opposed and off-set from each other along the axis of rotation of the crankshaft, and the first and second pins allow connecting rods to rotate around the pins, and wherein the first piston and the second piston comprise at least one of an O-ring and a wear band;

a motor coupled with the crankshaft to move the pistons;

a condenser to condense the refrigerant;

a housing to house the manifold, the compressor, the motor and the condenser;

a purge valve control configured to control a purge valve;

a first control to control the functionality of an inlet fitting;

a second control to control the functionality of an outlet fitting;

the housing having a front portion with the purge valve control, the first control, and the second control arranged on the front portion;

a fan; and an accessory shaft to receive the fan, wherein the accessory shaft and the fan have an axis of rotation the same as the axis of rotation of the crankshaft.

2. The machine of claim 1, wherein the first and second cylinders have grooves on an outside surface to assist in coding of the cylinders.

3. The machine of claim 1, wherein the manifold includes the purge valve.

4. The machine of claim 1, wherein the first and second pistons further include wear bands to reduce wear on the pistons and seals to create a seal between the pistons and the cylinders.

5. The machine of claim 1, further comprising a filter associated with the inlet fitting.

6. The machine of claim 1, further comprising a check valve configured to limit system pressure.

7. The machine of claim 1, wherein the first piston reciprocates in a first position and a second position within the first cylinder and the second piston reciprocates in a first position and a second position within the second cylinder.

8. The machine of claim 7, wherein the cylinders are movable to receive pistons that may be misaligned.

9. The machine of claim 7, wherein when the first piston is in the first position, the second piston will be in the second position and vice versa.

10. The machine of claim 7, wherein the first position is when the piston is not extended and creates a space to receive the refrigerant in the cylinder and the second position creates no space to receive the refrigerant in the cylinder.

11. The machine of claim 7, wherein the first position creates a first vacuum.

12. The machine of claim 11, wherein the first vacuum creates a second vacuum in a refrigerant containing device connected to the machine and from which the refrigerant is being recovered from.

13. A portable refrigerant recovery machine, comprising:

a manifold means for directing a refrigerant having an inlet valve means for receiving the refrigerant into the machine and an outlet valve means for exiting the refrigerant from the machine;

a compressing means for compressing the refrigerant from the manifold means, the compressing means further comprising:

a first head means for containing a first end of a first cylinder means and includes a first head inlet and a first head outlet;

a second head means for containing a first end of a second cylinder means includes a second head inlet and a second head outlet;

a crankcase means coupled to second ends of the first and second cylinders means;

a crankshaft for moving, having an axis of rotation, the crankshaft positioned within the crankcase means and the crankshaft comprises a single crankshaft journal connected to a first end of a first connecting rod means and a first end of a second connecting rod means such that the first end of the first connecting rod means and the first end of the second connecting rod means move in unison;

a first pin means for securing that secures a second end of the first connecting rod means to a first end of a first piston means; and a second pin means for securing that secures a second end of the second connecting rod means to a first end of a second piston means, wherein the first piston means and the second piston means are opposed and off-set from each other along the axis of rotation of the crankshaft, and the first and second pins means allow connecting rods means to rotate around the pins means, and wherein the first piston means and the second piston means comprise at least one of an O-ring and a wear band;

a motor means for rotating the crankshaft to move the pistons means;

a condensing means for condensing the refrigerant;

a housing means to house the manifold means, the compressing means, the motor means and the condensing means;

a purge valve control configured to control a purge valve;

a first control to control the functionality of an inlet fitting;

a second control to control the functionality of an outlet fitting;

the housing means having a front portion with the purge valve control, the first control, and the second control arranged on the front portion; a fan; and an accessory shaft to receive the fan, wherein the axis of the accessory shaft and the fan is the same as the axis of the crankshaft.

14. The machine of claim 13, wherein the first and second cylinders means have grooves on an outside surface to assist in cooling of the cylinders means.

15. The machine of claim 13, wherein the manifold means includes the purge valve.

16. The machine of claim 13, wherein the first and second pistons means further include wear bands to reduce wear on the pistons means and seals to create a seal between the pistons and the cylinders means.

17. The machine of claim 13, further comprising a filter associated with the inlet fitting.

18. The machine of claim 13, further comprising a check valve configured to limit system pressure.

19. The machine of claim 13, wherein the first piston means reciprocates in a first position and a second position within the first cylinder means and the second piston means reciprocates in a first position and a second position within the second cylinder means.

20. The machine of claim 19, wherein the cylinders means are movable to receive pistons means that may be misaligned.

21. The machine of claim 19, wherein when the first piston means is in a first position, the second piston means will be in a second position and vice versa.

22. The machine of claim 19, wherein the first position is when the piston means is not extended and creates a space to receive the refrigerant in the cylinder means and the second position creates no space to receive the refrigerant in the cylinder means.

23. The machine of claim 19, wherein the first position creates a first vacuum.

24. The machine of claim 23, wherein the first vacuum creates a second vacuum in a refrigerant containing device connected to the machine and from which the refrigerant is being recovered from.

25. A portable refrigerant recovery machine, comprising:

a manifold having an inlet valve to receive refrigerant into the machine and an outlet valve for exiting the refrigerant from the machine;

a compressor that receives the refrigerant from the manifold and compresses the refrigerant, the compressor further comprising:

a first head that receives a first end of a first cylinder and includes a first head inlet and a first head outlet;

a second head that receives a first end of a second cylinder and includes a second head inlet and a second head outlet;

a crankcase coupled to second ends of the first and second cylinders;

a crankshaft positioned within the crankcase, the crankshaft having an axis of rotation, and the crankshaft comprises a single crankshaft journal connected to a first end of a first connecting rod and a first end of a second connecting rod such that the first end of the first connecting rod and the first end of the second connecting rod move in unison;

a first pin that couples a second end of the first connecting rod to a first end of a first piston; and a second pin that couples a second end of the second connecting rod to a first end of a second piston, wherein the first piston and the second piston are opposed and off-set from each other along the axis of the crankshaft, and the first and second pins allow connecting rods to rotate around the pins, and wherein the first piston and the second piston comprise at least one of an O-ring and a wear band;

a motor coupled with the crankshaft to move the pistons;

a condenser to condense the refrigerant;

a housing to house the manifold, the compressor, the motor and the condenser;

a purge valve control configured to control a purge valve;

a first control to control the functionality of an inlet fitting;

a second control to control the functionality of an outlet fitting;

the housing having a front portion with the purge valve control, the first control, and the second control arranged on the front portion; a fan; and an accessory shaft configured to receive the fan, wherein the axis of the accessory shaft and the fan is arranged on the same axis of the crankshaft.

* * * * *